United States Patent [19]

Hahn et al.

[11] 4,166,424

[45] Sep. 4, 1979

[54] PRESS APPARATUS AND METHOD UTILIZING SAME

[75] Inventors: Kurt L. Hahn, San Rafael; Robert J. Allen, Daly City, both of Calif.

[73] Assignee: American Can Company, Greenwich, Conn.

[21] Appl. No.: 883,174

[22] Filed: Mar. 3, 1978

Related U.S. Application Data

[60] Division of Ser. No. 662,905, Mar. 1, 1976, Pat. No. 4,026,226, and a continuation of Ser. No. 764,213, Jan. 31, 1977, abandoned.

[51] Int. Cl.[2] ..... B21D 43/16

[52] U.S. Cl. ..... 113/114 BE; 221/268; 414/750

[58] Field of Search ..... 113/114 A, 114 B, 114 BA, 113/114 BB, 114 BC, 114 BD, 114 BE, 114 R; 221/268, 276, 292, 293, 131 B; 214/1 BB

[56] References Cited

U.S. PATENT DOCUMENTS

| | | | |
|---|---|---|---|
| 1,013,344 | 1/1912 | Wagner et al. | 113/114 BG |
| 1,133,383 | 3/1915 | Kriese | 113/114 BD |
| 1,750,391 | 3/1930 | Coyle et al. | 113/114 BG |
| 1,754,463 | 4/1930 | Erb | 113/114 BG |
| 2,332,531 | 10/1943 | Robinson et al. | 113/114 BA |
| 2,386,845 | 10/1945 | Diezel | 113/114 BA |
| 3,702,103 | 11/1972 | Price et al. | 113/114 BE |
| 4,019,452 | 4/1977 | Rouse | 113/114 BE |

*Primary Examiner*—Leon Gilden

*Attorney, Agent, or Firm*—Robert P. Auber; Ira S. Dorman; George P. Ziehmer

[57] ABSTRACT

An inverted conversion press for producing easy-open metal container ends is provided, which combines the functions of end and tab presses. The press includes a tab forming station and an end forming station, disposed one beneath the other and rendered alternately operative by a vertically-reciprocable slide assembly. A method for producing an article, comprised of assembled workpieces, is also provided.

2 Claims, 6 Drawing Figures

PRESS APPARATUS AND METHOD UTILIZING SAME

This is a continuation of application Ser. No. 764,213 filed Jan. 31, 1977 now abandoned and a division of application Ser. No. 662,905 filed Mar. 1, 1976, now U.S. Pat. No. 4,026,226.

BACKGROUND OF THE INVENTION

Various types of presses have previously been employed to produce metal container ends, such as those of the easy-open type having both push-in and tear-away opening tabs. However, such prior art machines have tended to have certain drawbacks: e.g., undue complexity, excessive space requirements, inefficiency, insufficient accuracy, speed, smoothness of operation and contamination control, and excessive power consumption.

Attempts have been made to improve upon the above-noted deficiencies; note, for example, the press described in U.S. Pat. No. 3,683,665. However, so far as is known, no presently-available press affords the advantages of that of the instant invention, nor lends itself to the production of container ends by the highly facile and economic method herein set forth.

Accordingly, it is an object of the present invention to provide a novel press which is compact, and of relatively simple design, and which is economical, durable and convenient to use.

It is also an object of this invention to provide a novel press which is efficient and is capable of smooth, high-speed operation.

A further object of this invention is to provide a novel press which minimizes contamination of the articles produced.

Still another object of the invention is to provide a novel press having the foregoing features and advantages, which is especially adapted for the production of metal container ends, and particularly easy-open ends having both push-in and tear-away opening tabs.

A more specific object of the invention is to provide a novel can end feeding mechanism for a press of the foregoing description.

Yet another object is to provide a novel and facile method for the production of an article comprised of assembled workpieces on a press of the foregoing description.

SUMMARY OF THE INVENTION

It has now been found that certain of the foregoing and related objects of the invention are readily attained in a conversion press having a frame, a pair of vertically-spaced, interconnected outer platens supported on the frame and having tooling disposed on the opposing faces thereof, and an inner platen supported on the frame between the outer platens and having tooling disposed on each of the opposite faces thereof. The tooling on one of the opposing faces of the outer platens and on the confronting opposite face of the inner platen defines a first forming station, and the tooling disposed on the other of the opposing faces and on the confronting opposite face of the inner platen defines a second forming station. Either the inner platen or (preferably) the pair of outer platens comprises movable means, and is mounted for vertical movement, enabling coaction of the tooling associated with both of the first and second forming stations. The press also has means for vertically reciprocating the movable means to alternately render operative the first and second forming stations, and means for transferring a first workpiece from the first forming station to the second forming station for effecting sequential operations thereon.

In a preferred embodiment, the tooling associated with each of the first and second forming stations defined a plurality of substations, the transfer means successively transfers the first workpieces from one to another of the substations of the first station, and means is provided for advancing second workpieces from one to another of the substations of the second station. In operation, the second workpieces are lifted by the lower platen, with the tooling thereof supporting the workpieces and acting thereon in cooperation with the tooling on the bottom face of the bolster plate, on the upstroke of the slide assembly. On the downstroke of the slide assembly, the tooling of the upper platen acts on the first workpieces in cooperation with the tooling on the top face of the bolster plate.

The substations of the second forming stations are desirably linearly-aligned, and the advancing means is comprised of a transfer bar mounted on the frame for horizontal reciprocation between the bolster plate and the lower platen, the transfer bar being operated by the reciprocating means in synchronism with the slide assembly. The transfer bar may have formed therein a plurality of linearly-aligned openings, with at least one slot extending along the axis of alignment of the openings and providing interconnection between adjacent ones thereof. Each of the openings is dimensioned and configured to seat therein, and to provide underlying support for, one of the second workpieces, and the slot is dimensioned and configured to permit tooling on the lower platen to pass therethrough. Additionally, the openings are spaced and aligned to correspond with the spacing and alignment of the substations of the second forming station. As a result, in lifting the second workpieces on the upstroke of the slide assembly, the tooling of the lower platen passes upwardly into and through the openings of the transfer bar, and the bar is reciprocable without lowering of the slide assembly, by passage of the tooling through the slot.

In especially preferred embodiments, the first workpieces at the first forming station are disposed in a web of extended length, and the transfer means includes a pair of indexing rolls, which are rotatably mounted on the frame with their axes parallel, and which are adapted to engage the web therebetween to thereby effect the transfer of the first workpieces from one to another of the substations of the first station. The reciprocating means, which most desirably is mounted on the frame generally below the lower platen, drives at least one of the indexing rolls to move the web in synchronism with the slide assembly. It is also desirable that the transfer means additionally includes a second pair of the indexing rolls, which indexes the web at the second station and cooperates with the first-mentioned pair of indexing rolls to effect transfer of the first workpieces to the second forming station. In such an embodiment, the reciprocating means drives at least one of the second pair of indexing rolls.

Most advantageously, the second forming station is comprised of a multiplicity of substations disposed in two rows, with the advancing means being adapted to successively transfer, in both of the rows, second workpieces from one substation to another in the same row. The advancing means is preferably a transfer bar having formed therein a multiplicity of openings and at least two slots. The openings, disposed in two rows, are spaced and aligned to correspond with the spacing and alignment of the substations of the second forming station and have a slot interconnecting adjacent ones thereof in each row. Each of the openings is dimensioned and configured to seat therein, and to provide underlying support for, one of the second workpieces, and the slots are dimensioned and configured to permit tooling on the lower platen to pass therethrough.

In another especially preferred embodiment, the press includes means for successively transferring a metal strip from one to another of the substations of the first station, and to transfer workpieces formed thereat to the second forming station, and means for advancing circular metal blanks from one to another of the substations of the second station. The tooling of the first station is adapted to at least partially form tab rings from metal strip during its passage therethrough, and the tooling of the second station is adapted to at least score metal blanks to define a removable panel therein, to form an integral rivet within the panel area, and to deform the rivet to attach a tab pull ring to the panel. The press is thus capable of producing easy-open, metal container ends from metal strip and metal blanks fed thereto.

Certain objects of the invention are attained in a can end blank feeding mechanism, which is suited for use with presses of the foregoing description, and which includes stacking means, for disposing a multiplicity of can end blanks in a vertical stack, and a transfer bar. The transfer bar has formed therein an opening which is dimensioned and configured to seat, and to provide underlying support for, one of the blanks, and a platform portion adjacent to the opening adapted to provide underlying support for a stack of blanks disposed in the stacking means. The bar is mounted for reciprocation in a horizontal plane beneath the stacking means, to alternately align the platform portion and the opening of the bar on the stacking axis thereof. The mechanism also includes a pair of blades mounted upon the transfer bar along opposite sides of the opening, which are disposed and adapted to pass between the lowermost and the adjacent blanks in the stack, to thereby separate the lowermost blank and permit it, upon alignment over the opening, to drop thereinto while the remainder of the stack is being supported upon the upper surfaces of the blades. The movement of the bar to align the platform portion on the stacking axis enables a stack of blanks in the stacking means to be supported thereon, with the lowermost and adjacent blanks of the stack being disposed thereon to permit entry of the blades therebetween. Most advantageously, the mechanism may include vacuum means to assist the transfer of blanks to the opening of the bar.

Other objects of the invention are attained in a method for producing an article comprised of assembled workpieces, on a press having first and second forming stations comprised of a plurality of substations and being disposed one above the other, the stations being rendered operative by a vertically-reciprocable slide constituting an operative portion thereof. The method includes, as an initial step, successively advancing a multiplicity of first workpieces from one substation to another substation of the first forming station to perform work thereon at both of the substations, and successively advancing a multiplicity of second workpieces from one substation to another substation of the second forming station to perform work thereon at both of the substations thereof. In synchronism with the advancement of the workpieces, the slide is vertically reciprocated to alternately render operative the first and second stations, and thus to perform work on the workpieces at the substations. Following completion of the work to be performed thereon at the first station, the first workpieces are successively advanced from the first forming station to the "another" substation of the second forming station, whereat one of the first and one of the second workpieces are assembled when the second station is rendered operative, thereby producing finished articles.

In the preferred embodiment of the method, easy-open, metal container ends are produced from metal strip and circular metal blanks, in accordance with which a metal strip is intermittently advanced from one substation to another substation of the first forming station, for at least partial conversion of the strip to a multiplicity of tab rings, and a multiplicity of metal blanks are successively advanced from one substation to another substation of the second forming station, to at least partially convert the blanks to end closures. In sychronism with the advancement of the strip and the blanks, the vertically-reciprocating slide alternately renders operative the first and second forming stations, performing work on the workpieces at the several substations thereof, thus effecting conversion of the strip and the blank. Following completion of the work to be performed on the strip at the first station, the tab rings so formed are successively advanced from the first forming station to the "another" substation of the second forming station, with one of the rings and one of the end closures being assembled at the "another" substation, when the second station is rendered operative, to thereby produce an easy-open container end.

Most desirably, in the foregoing method, the step of advancing the blanks is effected using a transfer bar, in a cycle of substeps comprising: (1) vertically aligning an opening of the bar with one substation of the second forming station, (2) lowering the blank worked upon at the one substation to seat it in the opening, (3) moving the transfer bar to vertically align the opening with the "another" substation of the second forming station, and (4) lifting the blank from the opening to perform work thereon at the "another" substation. Most desirably, following conversion of the strip to at least partially formed tab rings, the rings remain attached to the strip, with the strip intermittently being advanced to the "another" substation of the second forming station.

DETAILED DESCRIPTION OF THE ILLUSTRATED EMBODIMENT

Figure 1:
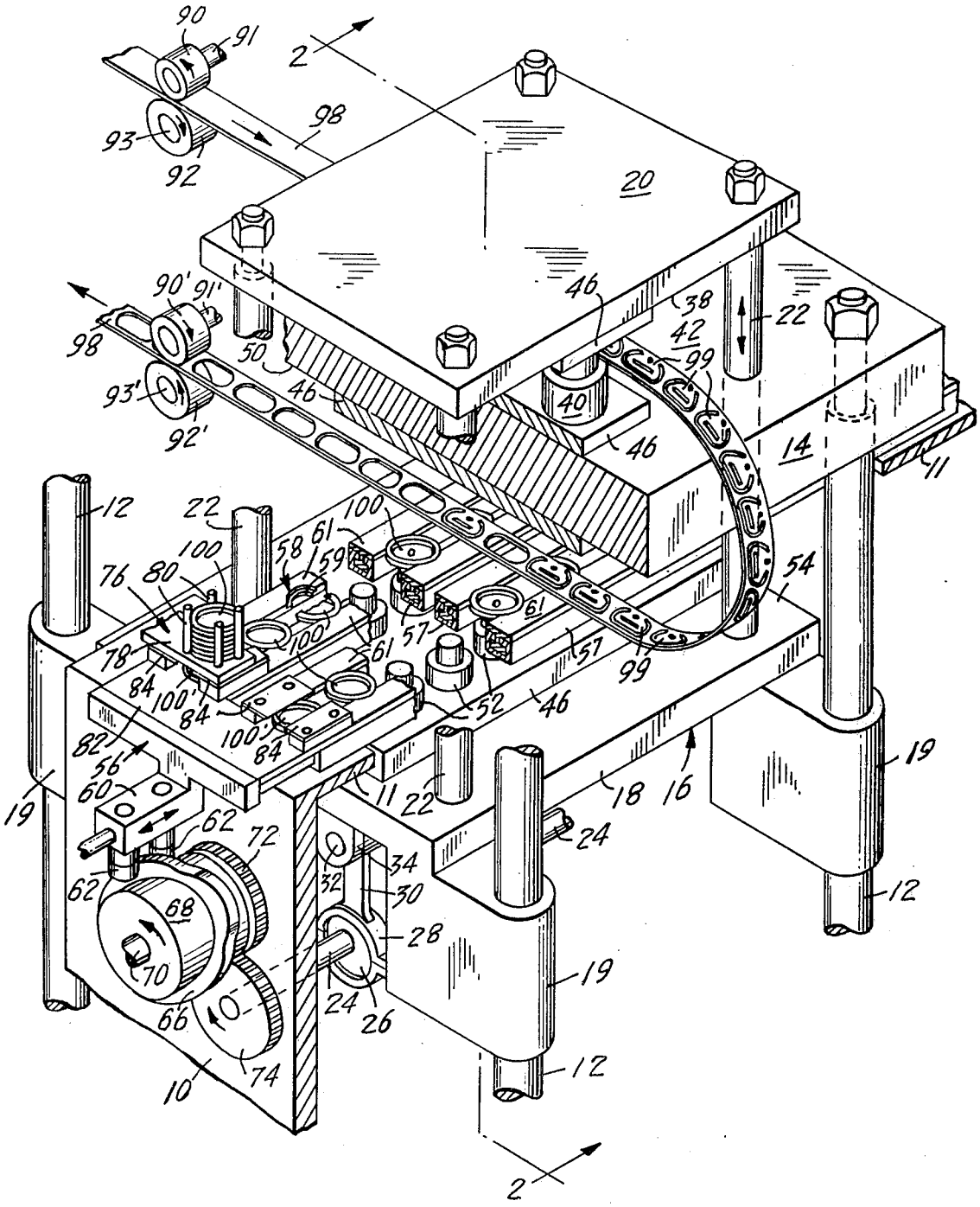
FIG. 1 is a fragmentary perspective view of an inverted conversion press embodying the present invention.

Turning now in detail to the appended drawings, therein illustrated is a conversion press embodying the present invention, including a frame (only portions of which are shown), generally designated by the numeral 10, having four upright cylindrical posts 12 to which a horizontal bolster plate 14 is rigidly secured. A vertically-reciprocable slide assembly, generally designated by the numeral 16, comprises a spaced pair of horizontal platens 18, 20 disposed respectively below and above the bolster plate 14. The lower platen 18 has corner sleeve portions 19 in which the posts 12 are slidably received, and is affixed to the upper platen 20 by four tie rods 22, which pass through holes 15 in the bolster plate 14; thus, the pair of platens 18, 20 comprising the slide assembly 16 are movable as a unit relative to the stationary bolster plate 14.

A crankshaft 24, driven by suitable means, (not shown), is rotatably mounted in the frame 10 beneath the slide assembly 16, and has an eccentric cam 26 secured to it. The cam 26 is disposed within the guide collar portion 28 of a pitman 30, the upper end of which is, in turn, pivotally connected by pin 32 to a yoke 34, which projects from the underside of the lower platen 18. As will be apparent, rotational motion of the shaft 24 is translated by the cam 26 and the pitman 30 into vertical reciprocation of the slide assembly 16.

Four linearly-aligned die sets consisting of upper and lower members 36, 40 are secured by means of fasteners 44 and die shoes 46, to the bottom face 38 of the upper platen 20 and to the top face 42 of the bolster plate, respectively. Each set defines a discrete substation of an upper forming station, at which tab pull rings for container end closures are produced from strip 98, fed thereto. Similarly, four end-forming die sets consisting of upper and lower members 48, 52, are secured by fasteners 44 and shoes 46 to the lower face 50 of plate 14 and upper face 54 of the lower platen 18, respectively. the die sets comprising members 48, 52 are disposed in two rows extending perpendicularly to the row of tab die sets of the upper forming station, and each coacting pair defines a discrete substation of a lower station at which forming operations are performed on the circular metal blanks 100, fed thereto to produce can end closure members.

Figure 6:
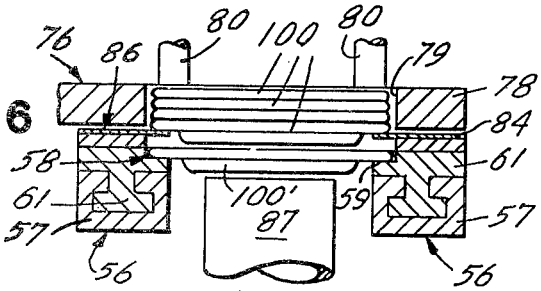
FIG. 6 is a cross-sectional view of the transfer bar of the previous figures, taken along line 6—6 of FIG. 3 and drawn to an enlarged scale.

In the lower forming station, the blanks 100 are successively advanced from one substation to the next (in the same row) by a transfer bar, generally designated by the numeral 56, comprised of a platform portion 82 at one end, and four transversely extending, spaced rack portions 61, of generally I-shaped cross-section. As will be noted, the underside of the platform portion 82 is configured to match the lower parts of the rack portions 61, to enable the transfer bar 56 to be slidably received in upwardly-opening U-shaped tracks 57, which are, in turn, supported by the inwardly-extending flange portions 11 of the frame 10. Each of the two inner rack portions 61 and the outer rack portion 61 adjacent to it constitute a set, in which a number of pockets are defined by cooperating arcuate recesses 58, which are formed in confronting relationship in the two rack portions 61 of both sets. As is best seen in FIG. 6, each recess 58 provides a ledge 59 which is dimensioned and configured to seat thereon, and to provide underlying support for, one of the end blanks 100. The pockets are spaced and aligned to correspond with the spacing and alignment of the end forming substations so that, in lifting the end blanks 100 on the upstroke of the slide assembly 16, the lower die members 52 pass upwardly through the pockets. The spacing between the rack portions 61 of each set is sufficient to permit the members 52 to pass therethrough, thereby enabling reciprocation of the transfer bar 56 with the slide assembly 16 in elevated positions. Because time is not lost to retraction of the slide assembly 16, as a prerequisite to movement of the transfer bar 56, the rates of operation are maximized.

The transfer bar 56 has a cam follower support block 60 projecting from below the platform portion 82, on which block is carried a pair of depending cam followers 62. A cam wheel 68, having an upstanding undulating rib 66, is secured to shaft 70, with the rib 66 disposed between the cam followers 62, causing them to ride on the opposite sides thereof. The shaft 70 is journaled in the frame 10, and carries a gear 72, which is in meshing engagement with the gear 74 mounted on the crankshaft 24. Accordingly, rotation of the crankshaft 24 turns the cam wheel 68, which movement is translated by the rib 66 and cam followers 62 into reciprocation of the transfer bar 56. Since the transfer bar 56 and the slide assembly 16 are driven from a common prime mover, their operation will be synchronized.

The end blanks 100 are supplied to the transfer bar 56 from a pair of feed chutes (only one of which is shown), generally designated by the numeral 76 and being comprised of a base 78 having a circular opening 79, and four upstanding posts 80, which laterally constrain a vertical stack of end blanks 100. As seen in comparing FIGS. 3 and 4, the illustrated chute 76 is supported above the transfer bar 56 (by means not shown) such that, due to the reciprocation of the transfer bar 56, its axis may alternately align over the platform portion 82 and the adjacent pocket defined by recesses 58 formed in the corresponding set of rack portions 61. As will be appreciated, the unillustrated chute is disposed for alignment over an adjacent part of the platform portion 82 and the first pocket of the other rack portion set. Rigidly secured to the rack portions 61, along opposite sides of each of the first pockets, is a pair of blades 84, which project inwardly over the ledges 59 of the recesses 58. The blades 84 are disposed to pass between lowermost blank 100' in each stack and the one directly above it, engaging opposite sides of their circumferential flanges; initial entry is depicted in FIG. 5. When the transfer bar 56 reaches its fully retracted position (shown in FIG. 3 and 6) the bottom blank 100' drops into the first pocket (then aligned under the feed chute 76), with the blanks 100 thereabove being supported upon the blades 86. Transfer of the end blanks 100 to the first pockets may be assisted from below by a downdraft or pressure differential established through a pair of vacuum pipes 87 (only one of which is shown), each of which is supported (by means not shown) below the transfer bar 56 and beneath one of the feed chutes 76, and both of which communicate with a vacuum source (not shown). As can be appreciated, utilization of the downdraft to facilitate the feeding of end blanks to the transfer bar will, in turn, permit higher press speeds. Upon extension of the bar 56, the remaining blanks 100 drop to the platform portion 82, and into position for entry of the blades 86 for feeding of the next blank 100.

In the upper forming station, the metal strip 98 is intermittently advanced to each of the tab forming substations by a pair of indexing rolls 90, 92, the upper roll 90 being mounted for free rotation on shaft 91 (supported by means not shown) and lower roll 92 being mounted on shaft 93, which is also supported by appropriate means and is driven through a suitable drive mechanism, such as a timing belt assembly, from crankshaft 24 (the support and driving mechanism also not being shown). The drive mechanism is so synchronized with the slide assembly 16 that, at the completion of the downstroke of the assembly 16, the drive roll 92 is driven to index the strip 98, engaged between it and the pressure roll 90, through the substations of the upper, tab forming station. The rolls 90, 92 also advance the strip 98 to a substation of each row thereof defined in the second or lower forming station. As will be noted, a second pair of indexing rolls 90', 92', similarly supported on shafts 91', 93' and driven in timed relationship to the movement of the slide assembly 16, is also provided. The second pair of rolls 90', 92' is operated 180° out of phase with that of the first pair 90, 92, so that the strip 98 is moved thereby following the upstroke of the slide assembly 16; in this way, the pairs of rolls cooperate to advance the strip 93 through both forming stations.

As mentioned hereinbefore, the tab and end forming stations of the press are alternately rendered operative by reciprocation of the slide assembly 16. The end blanks 100 are lifted by the lower platen 18 on the die members 52 mounted thereon, which coact with the mating die members 48 mounted on the stationary bolster plate 14, at the top of the stroke of the slide assembly 16 (FIG. 5). The tab die members 36 mounted on the upper platen 20 act on the metal strip 98, in cooperation with their mating members 40 mounted on the bolster plate 14, at the bottom of the stroke. Utilizing both ends of the stroke of the slide assembly to operate on the workpieces has been found to result not only in smoother operation and reduced wear, but also in increased efficiency, in terms of rates of production as well as power consumption. These benefits are believed to be due primarily to the increased capacity provided by two forming stations, and to the balanced load distribution resulting from the press configuration. Moreover, because the parts of the press which require the heaviest lubrication (i.e., the drive elements) are disposed beneath the forming stations, lubricant contamination of the workpieces is substantially reduced.

Figure 3:
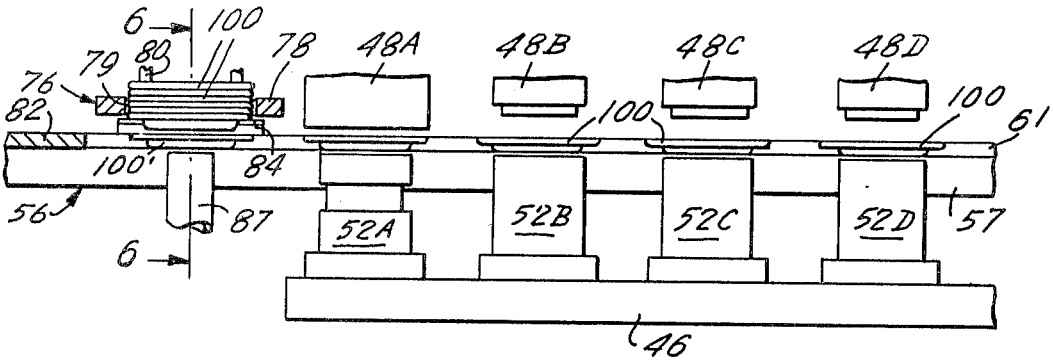
FIG. 3 is a fragmentary vertical cross-sectional view of the transfer bar of the press of FIG. 1 drawn to an enlarged scale, with the bar in its retracted position and the slide assembly lowered.
Figure 4:
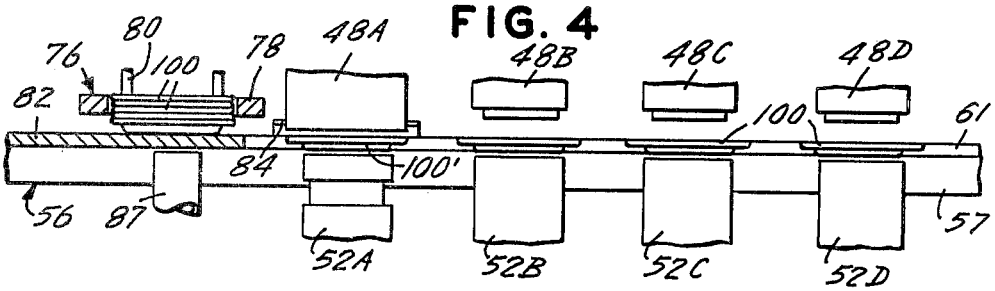
FIG. 4 is a view similar to that of FIG. 3, showing the transfer bar in its extended position, with the slide assembly on its upstroke.
Figure 5:
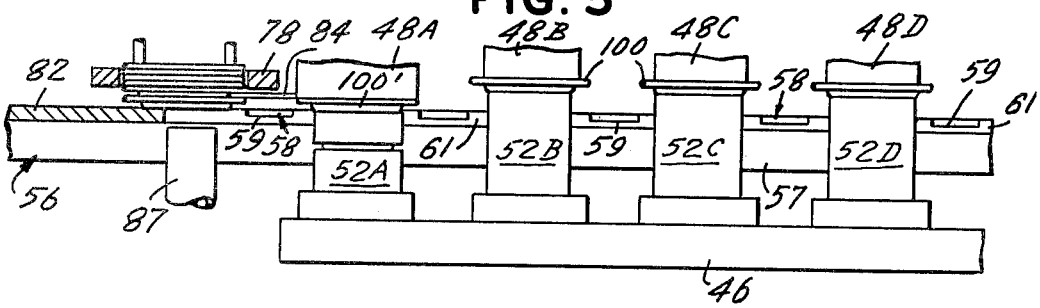
FIG. 5 is a view comparable to that of FIGS. 3 and 4, showing the transfer bar in an intermediate position, with the slide assembly in its most elevated position.

FIGS. 3, 4 and 5 show the advance of end blank along one row of formings substations. When the transfer bar 56 is fully retracted (FIGS. 3 and 6), a fresh blank 100' is deposited, assisted by vacuum, in the first pocket adjacent the platform portion 82, and the blades 84 support the remainder of the stack upon their upper surfaces 86. Movement of the transfer bar 56 forward (i.e., to the right, in the drawing) to its fully extended position (FIG. 4), advances blank 100' to a first substation defined by lower member 52A and upper member 48A, the remainder of the stack of blanks being supported by the platform portion 82. At this time, the slide assembly 16 is on the upstroke and member 52A is about to lift the blank 100' from the first pocket. As can be appreciated, lifting of the end blank 100' from the first pocket is limited by the overhanging blades 84 mounted above the pocket. However, both members 48 and 52 of the first die set are resiliently-mounted, so that they may accommodate both the travel restriction of the end blank 100' and further upward movement of the slide assembly 16, which is necessary to enable coaction of the other die sets. Thus, upon continued upward movement of the slide assembly 16, member 52A lifts the blank an amount sufficient to clear the first pocket, and to bring it into clamping engagement with the upper member 48A, whereby it is held while the transfer bar 56 returns to its retracted position to pick up the next blank; such an intermediate position is illustrated in FIG. 5.

As the transfer bar 56 moves rearwardly, the slide assembly 16 completes its upward stroke and starts downwardly. When the transfer position of FIGS. 3 and 6 is again attained, it will be appreciated that the blank 100' will have been deposited in the second pocket, and that another blank will have been separated form the stack is deposited into the first. In this manner, a succession of blanks 100 is shifted from substation to substation in the lower primary station, while the transfer bar 56 shuttles therethrough.

At the second substation of the lower station, the first of a series of forming operations is performed on the blanks. Thus, the overlying blank 100 is lifted by die member 52B from the position shown in FIG. 4 to that of FIG. 5, whereat member 52B cooperates with member 48B to perform an operation on the blank 100. Thereafter, the slide 16 moves downwardly to lower the blank 100 into the third pocket of the transfer bar 56, so as to position that blank for the operation of members 48C and 52C to be performed thereon. The blanks are successively advanced, in similar fashion, to each of the other end forming substations.

Figure 2:
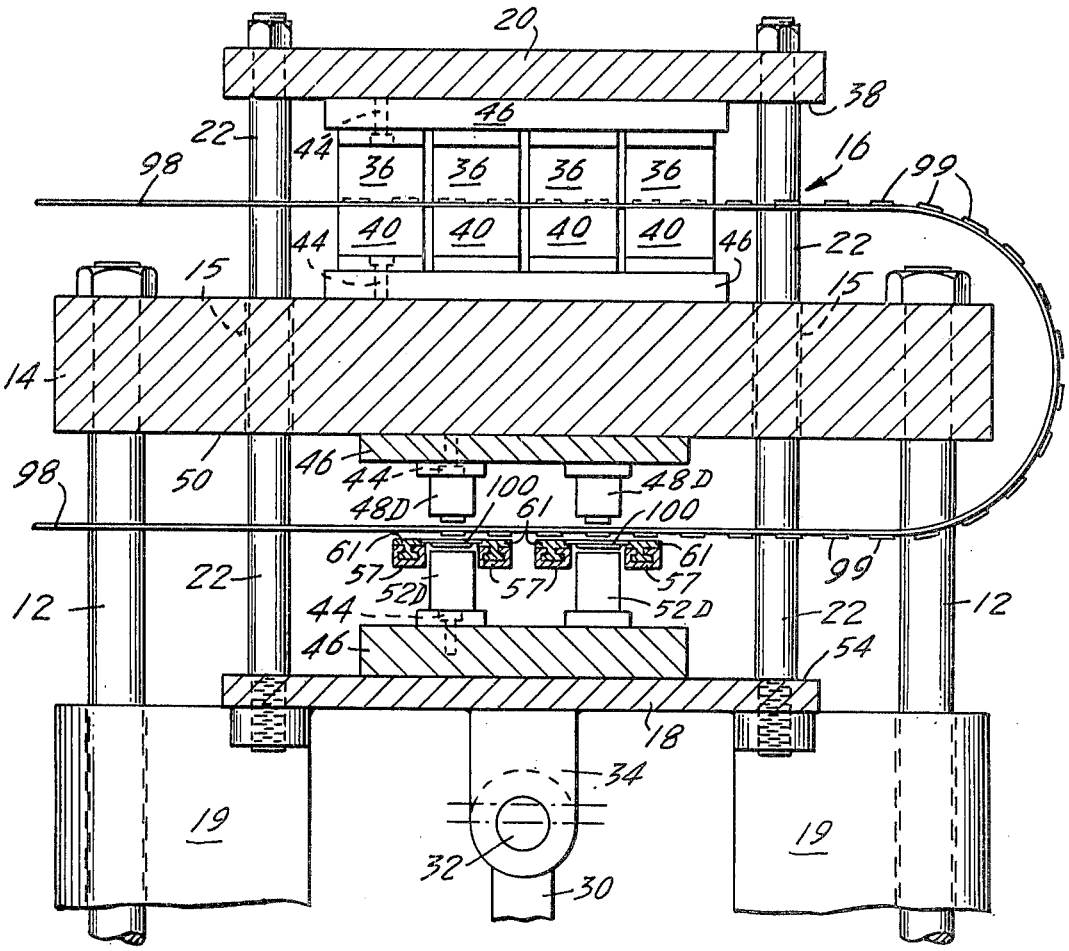
FIG. 2 is a vertical cross-sectional view along line 2—2 of FIG. 1, showing the upper portions of the press thereof.

Considering now the production of the metal tab pull rings, as seen in FIGS. 1 and 2, a metal strip 98 is intermittently advanced to successive tab forming substations of the upper station by the pairs of indexing rolls 90, 92, which advance the strip 98 by an amount sufficient to form two tabs, as is necessary to accommodate the two rows of end forming stations; as will be appreciated, each set of ring forming dies 36, 40 is duplicated to enable the simultaneous production of two rings. Following completion of the forming operations at the tab substations, the strip 98 containing the formed tab rings 99 (which are shown in FIG. 2 as raised elements, for purposes of illustration), is intermittently advanced by the rolls 90', 92' to position one of the tab rings 99 over the partially formed end disposed at an end forming substation of each of the rows. The relative positions of the tab rings 99 in the strip 98, and of the end forming substations, are selected to enable such operaton; these relationships are best shown in FIG. 2. On the upstroke of the slide assembly 16, side-by-side die members 52D lift the blanks 100 from the pockets of transfer bar 56 aligned thereover and, in cooperation with mating die members 48D, assemble the tab rings to the blanks. The end blanks with the tabs attached thereto are then advanced to the following end forming substations for effecting any sequential operations that may be performed thereon.

It should be noted that the rings 99 may be detached from the strip and fed by other means, such as through a vertical chute which terminates adjacent the appropriate end-forming substations. Additionally, it should also be pointed out that can ends which are fabricated from single rather than assembled workpieces, e.g., can ends having an integrally-formed push-in opening tab, may be produced on a press made in accordance with the present invention wherein only the lower end forming station is operated. It should also be noted that it may be possible to provide a press made in accordance with the instant invention wherein the bolster plate is mounted for vertical reciprocation relative to the pair of platens, instead of vice-versa. Moreover, other variations may, of course, be made to the illustrated embodiment without departing from the concepts of the invention.

Thus, it can be seen that the present invention provides a novel press that is compact and of relatively simple design. The press is economical, efficient, durable and convenient to use; it is capable of smooth, high-speed operation, during which contamination of the articles produced may be minimized, and is especially adapted for the production of metal container ends, and particularly easy-open ends having both push-in and tear-away opening tabs. The invention also provides a novel can end-feeding mechanism for a press of the foregoing description, as well as a novel and facile method for the production of an article comprised of assembled workpieces, on such a press.

What is claimed is:

1. A can end blank feeding mechanism, comprising:

stacking means for holding a plurality of can ends in a vertical stack of blanks;

a transfer bar having a plurality of linearly-aligned openings formed thereon each dimensioned and configured to seat therein, and to provide underlying support for, one of the blanks, said transfer bar having at least one slot extending along the axis of alignment of said openings and providing interconnection between adjacent openings thereof, said slot being dimensioned and configured to permit tooling to pass therethrough, and a platform portion adjacent to a first said opening, said transfer bar being mounted for reciprocation in a horizontal plane beneath said stacking means from a first position wherein said first opening is aligned with and beneath said stack to a second position of said transfer bar wherein said platform portion is aligned with and beneath said stack;

a pair of blades mounted upon said transfer bar along opposite sides of said first opening, said blades positioned and adapted to pass between the lower most and the adjacent blanks in said stack, to separate the lowermost blank and permit it, upon alignment over said first opening, to drop thereinto while the remainder of the stack is supported upon the upper surfaces of said blades, movement of said transfer bar to its second position enabling a stack of blanks in said stacking means to be supported on said platform portion, with the lowermost and adjacent blanks of the stack being disposed to permit entry of said blades therebetween upon movement of said transfer bar from its second to its first position;

and a plurality of means dimensioned and positioned to clear between sides of said slot, having an upward lifting action to lift and hold said blanks during the reciprocation of said bar from its second to its first position, and having a lowering action to lower said blanks into said openings prior to movement of said bar from its first to its second position.

2. The mechanism of claim 1 additionally including a vacuum source; and vacuum pipes connected to said source and supported below said transfer bar and beneath said stack of blanks to produce a downdraft to assist the transfer of blanks from said stack to said first opening.

* * * * *